US007434281B1

(12) United States Patent
Holliday et al.

(10) Patent No.: US 7,434,281 B1
(45) Date of Patent: Oct. 14, 2008

(54) PILLOW HAVING ANTI-WRINKLING PROPERTIES

(75) Inventors: James Mike Holliday, Hickory, NC (US); Bradley Coleman McNeely, Hickory, NC (US); James Alexander Wall, Hickory, NC (US); Gerry Borreggine, Hickory, NC (US)

(73) Assignee: I Care Sleep, LLC, Raleigh, NC (US)

( * ) Notice: Subject to any disclaimer, the term of this patent is extended or adjusted under 35 U.S.C. 154(b) by 0 days.

(21) Appl. No.: 11/904,930

(22) Filed: Sep. 28, 2007

(51) Int. Cl.
*A47G 9/00* (2006.01)

(52) U.S. Cl. ..... 5/636

(58) Field of Classification Search ..... 5/636, 5/638, 640, 646, 952; D6/601
See application file for complete search history.

(56) References Cited

U.S. PATENT DOCUMENTS

| | | | | |
|---|---|---|---|---|
| 2,167,622 A | | 8/1939 | Bentivoglio | 5/338 |
| 2,898,975 A | | 8/1959 | Wagner | 155/179 |
| 4,118,813 A | | 10/1978 | Armstrong | 5/337 |
| 4,207,636 A | * | 6/1980 | Ceriani | 428/101 |
| 4,606,088 A | * | 8/1986 | Michaelsen et al. | 5/636 |
| 4,748,702 A | | 6/1988 | Sandler | 5/434 |
| 4,850,067 A | | 7/1989 | Latorre | 5/431 |
| 4,908,893 A | | 3/1990 | Smit | 5/434 |
| 5,016,303 A | | 5/1991 | Tanaka et al. | 5/437 |
| 5,054,143 A | | 10/1991 | Javaher | 5/434 |
| 5,781,947 A | | 7/1998 | Sramek | 5/636 |
| 5,832,852 A | * | 11/1998 | Tornero et al. | 112/475.08 |
| 5,848,448 A | | 12/1998 | Boyd | 5/636 |
| 5,920,932 A | | 7/1999 | Hershgordon | 5/636 |
| 5,926,880 A | | 7/1999 | Sramek | 5/636 |
| 6,006,380 A | | 12/1999 | Sramek | 5/636 |
| 6,513,179 B1 | | 2/2003 | Pan | 5/636 |
| 6,574,809 B1 | | 6/2003 | Rathbun | 5/636 |
| 6,671,907 B1 | | 1/2004 | Zuberi | 5/636 |
| 6,915,539 B2 | | 7/2005 | Rathbun | 5/636 |
| 6,978,502 B2 | * | 12/2005 | Calagui | 5/640 |
| 7,020,919 B2 | | 4/2006 | Inaba | 5/638 |
| 7,082,633 B1 | | 8/2006 | Maarbjerg | 5/636 |
| 7,100,227 B2 | | 9/2006 | Frisbee | 5/640 |
| 7,127,759 B2 | | 10/2006 | Koops | 5/644 |
| 7,203,983 B1 | | 4/2007 | Reeves et al. | 5/636 |
| 7,213,280 B2 | | 5/2007 | Lavin et al. | 5/636 |
| 7,216,387 B2 | * | 5/2007 | Laxton | 5/636 |
| 2004/0139548 A1 | | 7/2004 | Hwang-Pao | 5/636 |
| 2006/0260055 A1 | | 11/2006 | Frisbee | 5/636 |
| 2006/0265808 A1 | | 11/2006 | Phillips | 5/637 |
| 2007/0011812 A1 | | 1/2007 | Drucker | 5/636 |

* cited by examiner

*Primary Examiner*—Alexander Grosz
(74) *Attorney, Agent, or Firm*—K&L Gates LLP

(57) ABSTRACT

A pillow for supporting the head of a user during sleeping includes a main body formed of a resiliently compressible foam material in a generally rectangular configuration having opposite ends with opposed upper and lower surfaces extending between the opposite ends. The lower surface is configured to overlie stably on a sleeping platform, and the upper surface is formed with beveled indentations adjacent the opposite ends of the main body and with a convex contour extending lengthwise between the beveled indentations presenting a generally central crown area and inclined facial support areas respectively sloping downwardly away from the crown area toward the beveled indentations. Each facial support area is adapted to impart a pulling effect on the facial skin of a user when lying thereon in a downwardly sloping orientation with a cheek of the user's face on the facial support area and the user's face facing the adjacent beveled indentation.

5 Claims, 2 Drawing Sheets

PILLOW HAVING ANTI-WRINKLING PROPERTIES

BACKGROUND OF THE INVENTION

The present invention relates generally to pillows adapted for use in supporting a user's head during sleeping and, more particularly, to sleeping pillows having a capability for deterring or minimizing the formation of wrinkles on a user's face during sleeping.

For many years, pillows used for sleeping have remained largely unchanged, typically being made of a rectangular textile covering stuffed with natural feathers, a comparable synthetic material, or a rectangular block of a compressible form. Over recent years, by contrast, a considerably greater amount of technological effort has been devoted to the design of specialized materials and configurations for pillows for various purposes ranging from improving comfort to prevention of snoring to the mitigation of facial wrinkling during sleeping. The diversity of pillow constructions known in the state of the art is representatively illustrated by U.S. Pat. Nos. 2,167,622; 2,898,975; 4,118,813; 4,748,702; 4,850,067; 4,908,893; 5,016,303; 5,054,143; 5,781,947; 5,848,448; 5,920,932; 5,926,880; 6,006,380; 6,513,179; 6,574,809; 6,671,907; 6,915,539; 7,020,919; 7,082,633; 7,100,227; 7,127,759; 7,203,983; 7,213,280; and 7,216,387; and by published U.S. Patent Applications Nos. 2004/0139548; 2006/0260055; 2006/0265808; 2007/0011812.

Of these patents, U.S. Pat. Nos. 4,908,893; 5,054,143; 5,781,947; 5,848,448; 5,926,880; 6,006,380; 6,574,809; and 6,915,539; and published U.S. Patent Application No. 2006/0265808, are specifically concerned with the prevention or deterrence of the tendency of a user's face to wrinkle during sleeping.

It is not believed that any of the anti-wrinkle pillows proposed in the above-identified patents have ever met with any significant degree of commercial success, yet the attention to this problem evidenced by the developmental efforts devoted to these pillow constructions indicates the existence of a recognized desire and need among consumers for a pillow which will effectively mitigate facial wrinkling during sleeping.

SUMMARY OF THE INVENTION

It is accordingly an object of the present invention to provide an improved head support pillow which will deter or minimize the formation of facial wrinkles on a user while sleeping.

Briefly summarized, the present invention contemplates the formation of such a pillow to comprise a main body formed of a resiliently compressible foam material in a generally rectangular configuration having opposite ends with opposed upper and lower surfaces extending between the opposite ends. The lower surface is configured to overlie in a stable manner a sleeping platform, such as a mattress or the like. In accordance with the present invention, the upper surface of the main body of the pillow is formed with beveled indentations adjacent the opposite end of the main body and with a convex contour extending lengthwise between the beveled indentations so as to present a generally central crown area and inclined facial support areas sloping respectively downwardly away from the crown area towards the beveled indentations. In this manner, each facial support area is adapted to impart a pulling effect on the facial skin of a user when lying thereon in a downwardly sloping orientation with a cheek of the user's face on the facial support area and the user's face facing the adjacent beveled indentation. Such a pulling effect over the course of sleeping on the pillow is intended to prevent or at least deter the formation of wrinkles on the user's face.

In a preferred embodiment of the pillow of the present invention, a supplementary layer of fiber extends over the upper surface of the main body between the beveled indentations. The main body of the pillow may be formed of any suitable foam material, but a visco-elastic so-called "memory" foam material is believed to be preferred. The pillow is preferably encased within a cover generally enclosing the main body. The cover may be of any of various materials, but is preferably made of a material treated with an anti-microbial agent or otherwise having anti-microbial properties.

DETAILED DESCRIPTION OF THE PREFERRED EMBODIMENTS

Figure 1:
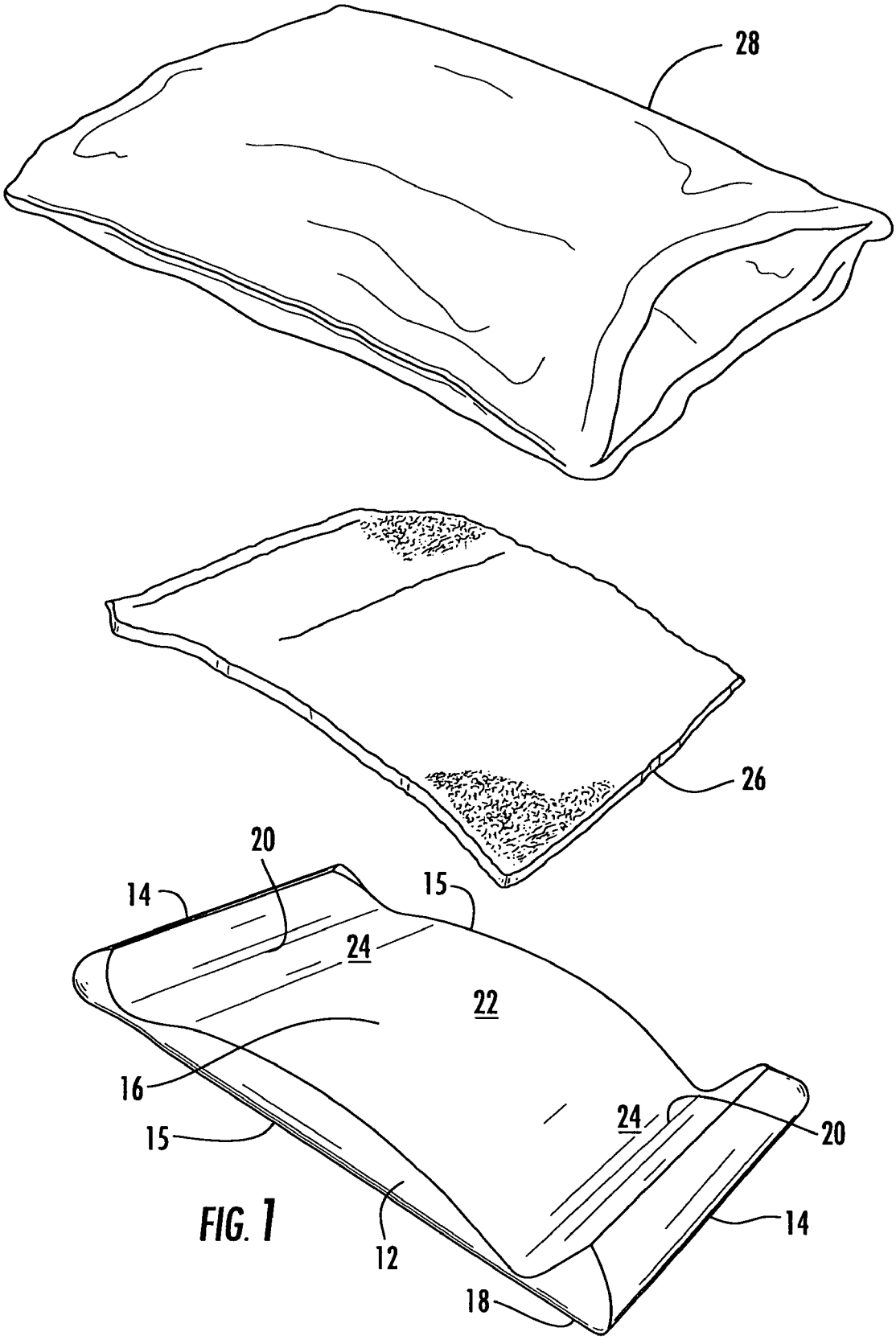
FIG. 1 is an exploded perspective view of a sleeping pillow according to a preferred embodiment of the present invention.

Referring now to the accompanying drawings and initially to FIG. 1, a pillow in accordance with the present invention is depicted in three-dimensional perspective view with its constituent components exploded for clarity, the pillow in its totality being indicated by the referenced numeral 10. The pillow 10 basically comprises a main body 12 having a layer of fiber batting 26 adhered to an upper surface 16 of the main body 12, all of which is encased within a surrounding textile covering 28.

The main body 12 of the pillow 10 is preferably formed of a resiliently compressible foam material, which may be any of various known types of polymeric foam including by way of example but without limitation polyurethane foam, synthetic so-called foam rubber, latex foam, or visco-elastic foam (commonly referred to as "memory" foam). A visco-elastic "memory" foam material is preferred for its ability to mold and conform to the shape of an object lying thereon and to spread uniformly the force of pressure exerted by the object.

The main body is preferably cut from a single homogenous unitary block of the selected foam material into an essentially rectangular overall configuration with a generally flat downwardly-facing bottom surface 18 and a contoured upwardly-facing top surface 16, rounded at the opposite lengthwise ends 14 and sides 15. The contoured top surface 16 is preferably formed with angular V-shaped bevel-like indentations 20 extending from one side 15 to the other side 15 closely adjacent each opposite end 14 of the main body 12, with the intervening extent of the top surface 16 between the indentations 20 being of a generally rounded convex shape forming a centrally located crown area 22 with two facial support areas 24 extending at a downwardly inclined slope from the crown area 22 toward the respective indentations 20. The main body 12 may advantageously be cut into this desired three-dimensional configuration utilizing any known form of computer numerically controlled (CNC) cutting machine.

The fiber batting 26 may be formed of any of various types of natural or synthetic fiber, preferably in a three-dimensional non-woven construction and preferably of a substantially uniform thickness. A non-woven melt-bonded batting of low-melt polyester fiber has been found to perform suitably, but a cotton batting or other forms of fiberous batting may also be utilized. The batting 26 is adhesively bonded over substantially the entire upwardly facing contoured area of the top surface 16 of the main body 12 between the indentations 20 and between the opposite sides 15 of the main body 12. The fiber batting promotes a comfortable hand and feel to the upwardly facing surface of the main body 12.

The textile case 28 enclosing the assembly of the main body 12 and fiber batting 26 is fashioned into the form of an enclosed envelope closely fitted in surrounding relationship thereto. The case 28 may be fashioned from substantially any form of suitable textile material, including woven and knitted fabric of natural and synthetic fibers or filaments. A particularly advantageous form of textile case 28 is made from "Cuprotex" textile fabrics made of copper-infused "Cupron" yarns marketed by Cuprotex, LLC, Greensboro, N.C. Such a textile case 28 provides anti-microbial (anti-fungal and anti-bacterial) properties, and is allergen and odor free.

Figure 2:
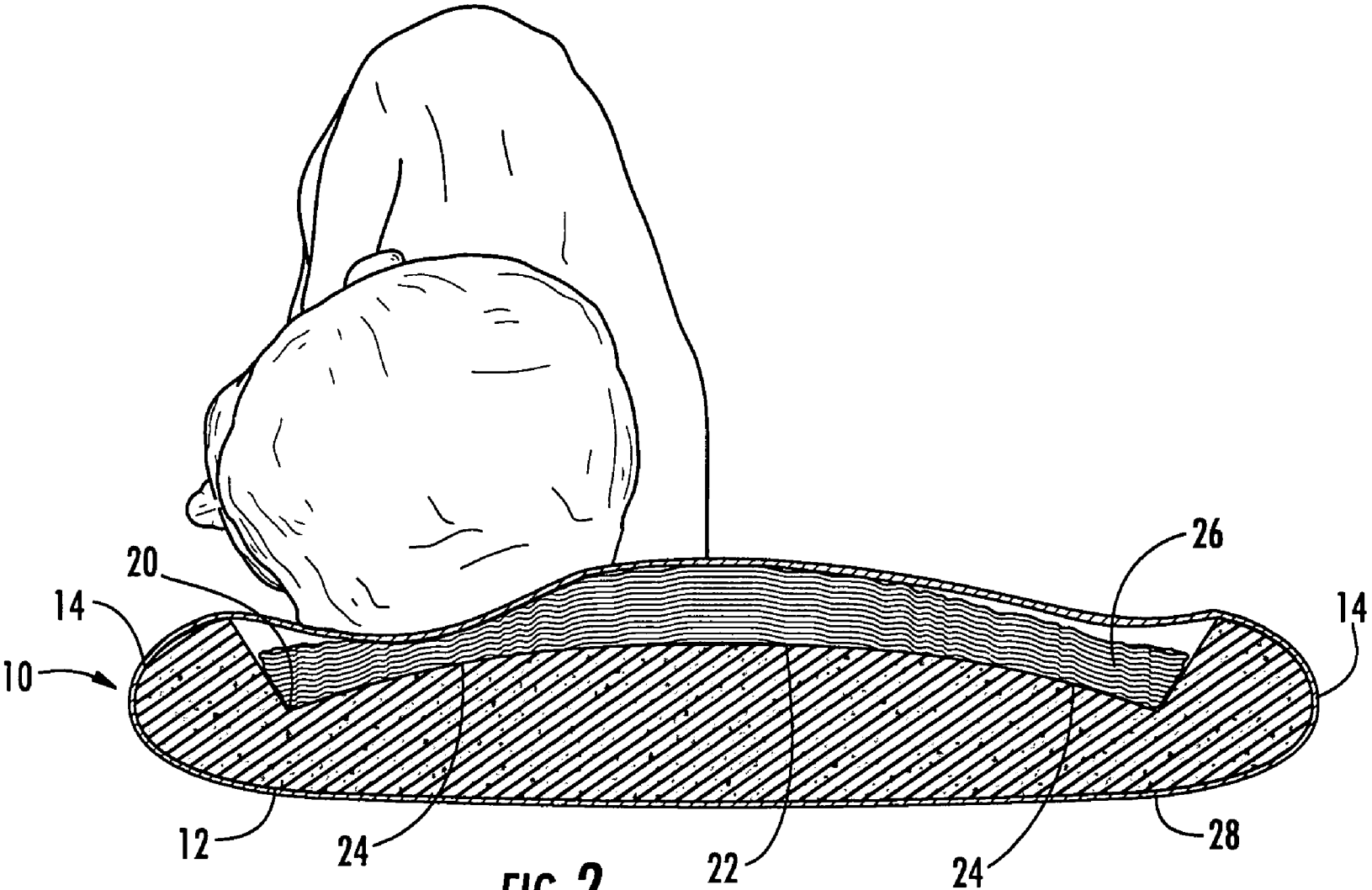
FIG. 2 depicts the pillow of FIG. 1 in use by a user.

As depicted in FIG. 2, the pillow 10 of the present invention in use serves to minimize and mitigate the formation of facial wrinkles on a person sleeping on the pillow 10. Specifically, the contoured top surface 16 of the main body 12 of the pillow 10 presents two separate facial support areas 24 configured for a user's head to lay thereon with one side of the user's face thereon in facing relationship to the adjacent indentation 20, as illustrated in FIG. 2. In such a disposition, a slight gravitational pull is exerted on the user's head due to the downwardly sloping orientation of the user's head on the facial support area 24. In this manner, a pulling effect is imparted to the facial skin of the user, primarily in the area of the cheek, chin and forehead, thereby resisting the formation of wrinkles in the facial skin as the user rests on the pillow. The contoured configuration of the top surface 16 of the pillow body 12 tends to maintain the user's head in such orientation on the pillow 10, so as to maintain the anti-wrinkling effect over the course of sleeping on the pillow.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A pillow for supporting the head of a user during sleeping, the pillow comprising:

a main body formed of a resiliently compressible foam material in a generally rectangular configuration having opposite ends with opposed upper and lower surfaces extending between the opposite ends, the lower surface being configured to overlie stably on a sleeping platform, the upper surface being formed with beveled indentations adjacent the opposite ends of the main body and with a convex contour extending lengthwise between the beveled indentations presenting a generally central crown area and inclined facial support areas respectively sloping downwardly away from the crown area toward the beveled indentations, each facial support area being adapted to impart a pulling effect on the facial skin of a user when lying thereon in a downwardly sloping orientation with a cheek of the user's face on the facial support area and the user's face facing the adjacent beveled indentation.

2. A pillow for supporting the head of a user during sleeping according to claim 1, wherein the main body comprises a visco-elastic foam material.

3. A pillow for supporting the head of a user during sleeping according to claim 1, further comprising a cover generally enclosing the main body.

4. A pillow for supporting the head of a user during sleeping according to claim 1, wherein the cover includes anti-microbial properties.

5. A pillow for supporting the head of a user during sleeping, the pillow comprising:

a main body formed of a resiliently compressible foam material in a generally rectangular configuration having opposite ends with opposed upper and lower surfaces extending between the opposite ends, the lower surface being configured to overlie stably on a sleeping platform, the upper surface being formed with beveled indentations adjacent the opposite ends of the main body and with a convex contour extending lengthwise between the beveled indentations presenting a generally central crown area and inclined facial support areas respectively sloping downwardly away from the crown area toward the beveled indentations, each facial support area being adapted to impart a pulling effect on the facial skin of a user when lying thereon in a downwardly sloping orientation with a cheek of the user's face on the facial support area and the user's face facing the adjacent beveled indentation, and a layer of fiber extending over the upper surface of the main body between the beveled indentations.

* * * * *